United States Patent [19]

Kanavas

[11] 4,139,198

[45] Feb. 13, 1979

[54] TRAINING DEVICE FOR IMPROVING ACCURACY IN HITTING A BALL

[76] Inventor: James G. Kanavas, 38751 Delafield Rd., Oconomowoc, Wis. 53066

[21] Appl. No.: 843,981

[22] Filed: Oct. 20, 1977

[51] Int. Cl.[2] ..... A63B 69/36

[52] U.S. Cl. ..... 273/186 A; 273/29 A

[58] Field of Search ..... 273/194 R, 194 A, 162 R, 273/162 E, 186 A, 186 C, 183 D, 177 R, 178 R, 180, 162 D, 32 A, 29 A, 26 B, 193 R, 193 A, 193 B, 162 D; 85/50 C

[56] References Cited

U.S. PATENT DOCUMENTS

| | | | |
|---|---|---|---|
| 2,057,821 | 10/1936 | Costello | 273/194 A |
| 2,094,766 | 10/1937 | Costello | 273/186 E |
| 3,749,362 | 7/1973 | O'Connor et al. | 85/50 C X |
| 3,912,277 | 10/1975 | Pelz | 273/186 A |

FOREIGN PATENT DOCUMENTS

| | | | |
|---|---|---|---|
| 207138 | 11/1923 | United Kingdom | 273/162 E |

*Primary Examiner*—George J. Marlo
*Attorney, Agent, or Firm*—Ira Milton Jones & Associates

[57] ABSTRACT

A training device which a golfer can attach to his putter to assist him in developing putting proficiency. The device consists of a rigid annulus having a flat back surface and a concave conical front surface that meet to form the inner edge of the annulus, the diameter of which is smaller than that of a conventional golf ball but large enough to permit the ball to contact the face of a putter to which the training device is attached without also contacting any part of the annulus. Attaching wings projecting in opposite directions from the annulus have flat back surfaces that are coplanar with the back surface of the annulus, to facilitate attaching the training device to a putter.

2 Claims, 4 Drawing Figures

TRAINING DEVICE FOR IMPROVING ACCURACY IN HITTING A BALL

This invention relates very broadly to sports equipment, but refers more particularly to a training device to assist in acquiring the desired accuracy in hitting a ball.

In every sport or game in which a ball is hit with a club, a bat, a racket or other hand-held and swung implement, the player's proficiency depends to a large degree upon the orientation of the ball-striking face of the club or other implement with respect to the orbit of its swing and its disposition at the moment of its initial contact with the ball. This is especially true on the putting green.

As every golfer—professional or rank amateur—knows, accuracy in putting is an inescapable requirement to a decent score. Unless the player hits the ball with the "sweet spot" on the face of the putter, the chances of the ball rolling to where he wishes it to go are slight and depend upon luck.

Accordingly, serious golfers spend a great deal of time practicing putting. The concentration involved in that practice can become nerve wracking, especially since the consequences of striking the ball improperly often are not too readily apparent.

With a view toward making it easier to see the results of improperly gripping and swinging or stroking the club, this invention has as its purpose and object to provide a training device that can be quickly and easily attached to, and removed from, any gold club— and especially any putter, by which improper disposition of the face of the club at the instant of contact with the ball results in greatly magnified deviation of the path of the ball from its intended line of travel.

To the attainment of that objective the training device of this invention consists of an annulus that is readily attachable to and removable from the head of the club in fixed and encircling relationship to the "sweet spot" on the face of the club head where initial contact with the ball should be made, the annulus having front and back surfaces, the latter contacting the face of the club head when the training device is attached thereto, the opening defined by the inner edge of the annulus being of such size when compared to the diameter of the ball to be struck that no part of the annulus contacts the ball when the point of initial contact between the ball and the face of the club head is at its "sweet spot"; and all parts of the front surface of the annulus being inwardly and rearwardly inclined, so that in the event the point of initial contact with the ball as it is struck is anywhere on the inclined front surface of the annulus, the consequent divergence of the path of the struck ball from its intended line of travel will be significantly magnified.

With these observations and objectives in mind, the manner in which the invention achieves its purpose will be appreciated from the following description and the accompanying drawing, which exemplifies the invention, it being understood that changes may be made in the specific structure disclosed herein without departing from the essentials of the invention set forth in the appended claims.

The accompanying drawing illustrates one complete example of the embodiment of the invention constructed according to the best mode so far devised for the practical application of the principles thereof, and in which.

Figure 1:
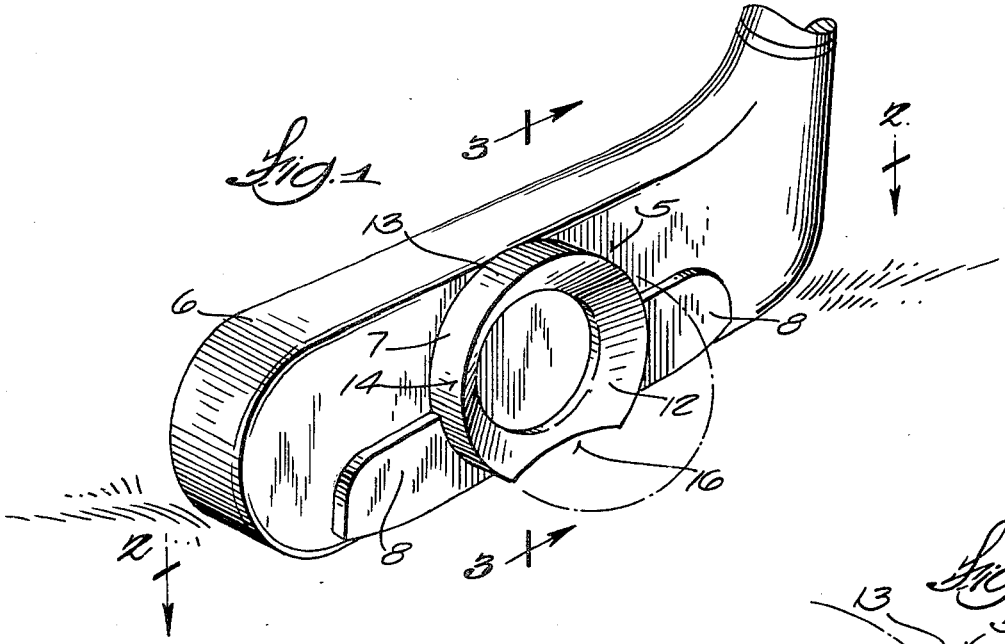
FIG. 1 is a perspective view of one form of the training device of this invention, mounted on a golf club—specifically, a putter.

Referring to the drawings, the numeral 5 designates the training device of this invention mounted on the head 6 of a golf putter.

Although the training device can be made of any suitable material and by any method, it is conveniently produced as a plastic molding. It consists of an annulus 7 with integral wings 8 projecting in opposite directions from the annulus.

The annulus and the wings have flat coplanar back surfaces which overlie the face of the putter when the training device is mounted thereon. Attachment can be effected in any suitable way as by pressing pieces or discs 10 of double-faced pressure sensitive adhesive material between the face of the putter and the back surface of the wings.

The front surface 12 of the annulus is concavely conical and has its large diameter front end joined to a cylindrical side surface 13 at a relatively sharply defined circular edge 14 that lies in a plane parallel to the flat back surface of the annulus. Preferably the thickness of the wings is less than the distance between the circular edge 14 and the back surface of the annulus, so that if desired, additional securement of the training device to the putter head in the form of tape wrapped around the putter head and the wings 8 can be applied without having any part thereof project forwardly of the edge 14.

Figure 2:
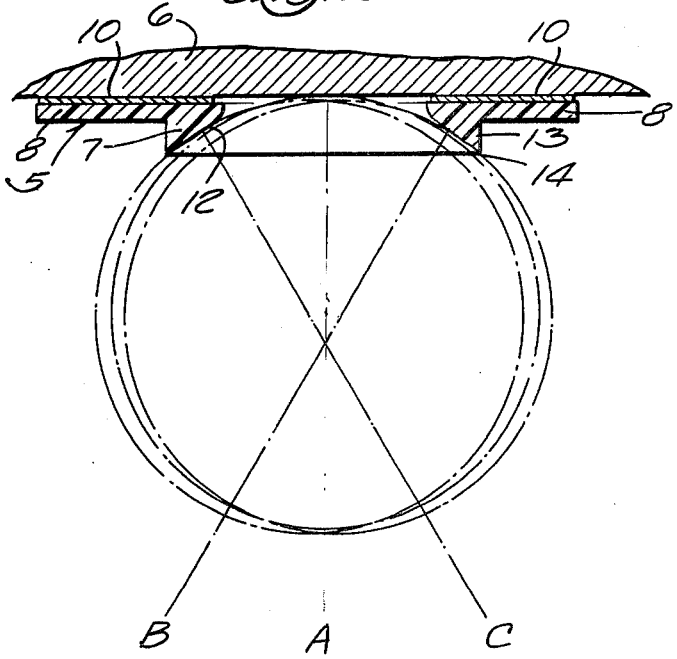
FIG. 2 is a horizontal sectional view through FIG. 1 on the plane of the line 2—2.

Being conical, as it is, the front surface 12 of the annulus—which, incidentally, is also its radially inner surface—forms a uniformly inwardly and rearwardly inclined circular wall that leads from the front edge 14 of the annulus to its back surface. At its rearmost end, the inside diameter of the annulus, which is its smallest, is such compared to the diameter of a golf ball that no part of the annulus contacts the ball when the ball is properly struck. Therefore, if the training device is properly placed on the club head, which means that the center of its annulus is on the "sweet spot" of the club face, the path of the ball if properly struck will be as desired—along the line A in FIG. 2.

But if, for any reason, the aforesaid correct relationship does not exist between the face of the club head and the center of the ball, the point of initial contact will be at some spot on the conical front surface 12 of the annulus. As a result, the ball will not travel along the desired line. The important observation here is that, even though the displacement of the club head from its proper orientation may be slight, the evidence of that slight departure will be greatly magnified by the significant divergence of the path of the ball from its intended line of travel—as depicted by the lines B and C in FIG. 2.

The location of the "sweet spot" on the face of the club head is usually identified in some way, as by a line across the top of the club head. However, if perchance the location of the "sweet spot" is not identified, it can be located in the customary manner by suspending the club with a flexible cord or line tied to the grip of the club from a point adjacent to a perpendicular reference line or edge—as, for instance, the edge of a doorway. With the putter thus suspended and rotated so that its head crosses the perpendicular reference line, the location of the "sweet spot" will be where the projection of that line crosses the face of the putter head. Thus identified, the location of the "sweet spot" should be marked in an appropriate manner.

Figure 3:
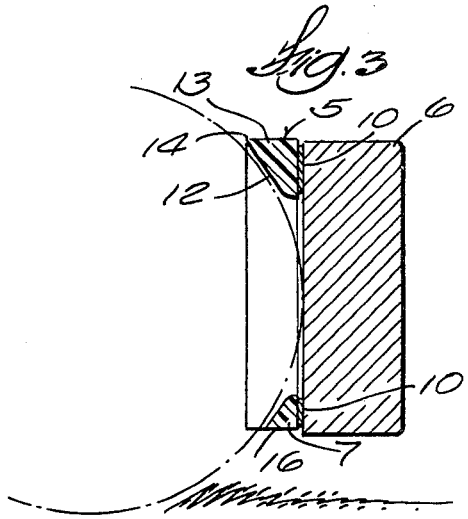
FIG. 3 is a vertical sectional view through FIG. 1 on the plane of the lie 3—3.

To facilitate proper placement of the training device on the putter head, the bottom portion of its annulus is preferably slabbed off to form a substantially flat bottom surface 16 that is coplanar with the bottom edge of the wings. As best shown in FIG. 1, this surface 16 lies in a plane that chordally intersects the annulus radially outwardly of its inner edge and that is perpendicular to the flat back surface of the annulus. Alignment of this flat bottom surface with the lower edge of the putter head as shown in FIG. 3, and centering its annulus with the "sweet spot" properly locates the training device on the putter head.

With the flat bottom of the training device properly aligned with the bottom edge of the putter and the putter head perfectly level i.e., horizontal, at the instant of impact with the ball, the path of its travel should be true to the target, providing of course that the point of contact was on the "sweet spot" of the putter head. If desired the annulus 7 of the training device can be equipped with a spirit level to indicate when the club head is horizontal. Also, if desired, a sighting hole or slit may be formed through the top of the annulus to facilitate aligning the "sweet spot" with the ball.

Although the concavely conical shape of the radially inwardly facing front surface 12 of the annulus is best suited to its purpose, some deviation from its truly circular form, as for instance a multi-sided trucatedly pyramidal shape, could be used.

Figure 4:
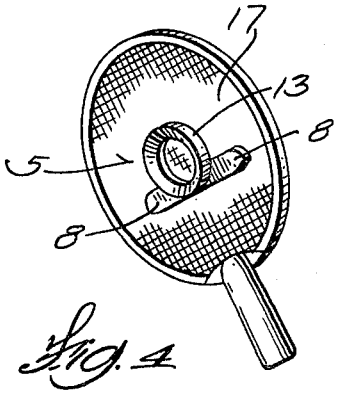
FIG. 4 is a perspective view of the training device mounted on a racket.

As indicated hereinbefore, while the training device of this invention is no doubt most useful in improving one's game of golf, and especially the putting portion thereof, it can be used to advantage in other sports. Illustrative of such other uses, is the adaptation of the training device to a racket ball racket 17, as shown in FIG. 4.

Those skilled in the art will appreciate that the invention can be embodied in forms other than as herein disclosed for purposes of illustration.

The invention is defined by the following claims:

I claim:

1. A training device to help golfers gain accuracy in meeting the ball as it is struck with a golf club, said device comprising:

A. a rigid annulus having a flat back surface and a concave substantially conical front surface, said surfaces meeting to form a relatively sharply defined inner edge for the annulus;

B. attaching wings projecting in opposite directions from the annulus, said attaching wings having flat back surfaces that are coplanar with the back surface of the annulus;

C. means on said attaching flanges by which the annulus is securable to the face of a golf club head in a predetermined position encircling and centered with respect to the spot on the face of the club head at which contact with the ball should occur as it is struck for the ball to travel along its intended path;

D. a guide surface on said annulus to facilitate placement of the annulus in said predetermined position on the head of a golf club, said guide surface being substantially flat and extending across the annulus in a plane that is substantially perpendicular to the flat back surface of the annulus and that chordally intersects the annulus radially outwardly of its inner edge at a distance from the center of the annulus such that upon alignment of said guide surface with the lower edge of a gold club head during securement of the annulus thereto, the annulus can be quickly and easily properly positioned on the club head; and E. the diameter of the inner edge of the annulus being smaller than that of a conventional golf ball but large enough to permit contact between the ball and the face of the club head when such contact is made at said predetermined spot on the face of the club head.

2. The training device defined by claim 1, further characterized in that said guide surface also extends along the attaching wings and forms an edge thereof.

* * * * *